US007859383B2

(12) United States Patent
Lee

(10) Patent No.: US 7,859,383 B2
(45) Date of Patent: Dec. 28, 2010

(54) SPIRAL INDUCTOR WITH MULTI-TRACE STRUCTURE

(75) Inventor: Sheng-Yuan Lee, Taipei (TW)

(73) Assignee: Via Technologies, Inc., Hsin-Tien, Taipei (TW)

( * ) Notice: Subject to any disclaimer, the term of this patent is extended or adjusted under 35 U.S.C. 154(b) by 0 days.

(21) Appl. No.: 12/581,949

(22) Filed: Oct. 20, 2009

(65) Prior Publication Data

US 2010/0039205 A1 Feb. 18, 2010

Related U.S. Application Data

(62) Division of application No. 11/774,094, filed on Jul. 6, 2007, now Pat. No. 7,626,480.

(30) Foreign Application Priority Data

Jan. 12, 2007 (TW) ..... 96101237 A

(51) Int. Cl.
*H01F 5/00* (2006.01)

(52) U.S. Cl. ..... 336/200

(58) Field of Classification Search ..... 336/65, 336/83, 200, 232; 257/531
See application file for complete search history.

(56) References Cited

U.S. PATENT DOCUMENTS 5,892,425 A * 4/1999 Kuhn et al. ..... 336/200
6,476,704 B2 * 11/2002 Goff ..... 336/200
6,870,256 B2 3/2005 Aoki et al.
6,922,126 B1 7/2005 Okamoto
7,460,001 B2 12/2008 Jessie
2006/0220773 A1 10/2006 Su

* cited by examiner

*Primary Examiner*—Tuyen Nguyen
(74) *Attorney, Agent, or Firm*—Thomas, Kayden, Horstemeyer & Risley

(57) ABSTRACT

A spiral inductor with a multi-trace structure having an insulating layer disposed on a substrate. A first spiral conductive trace with multiple turns is disposed on the insulating layer, wherein the outermost turn and the innermost turn of the first spiral conductive trace have a first end and a second end, respectively, and one of the first and second ends is connected to ground. A second spiral conductive trace with a single turn is disposed on the insulating layer and adjacent to the first spiral conductive trace, wherein the second spiral conductive trace is electrically connected to the turn that is connected to the ground and belongs to the first spiral conductive trace. The first spiral conductive trace has a relative outside and a relative inside, wherein the end of the first spiral conductive trace connected to ground and the second spiral conductive trace are located at different sides respectively.

6 Claims, 5 Drawing Sheets

SPIRAL INDUCTOR WITH MULTI-TRACE STRUCTURE

CROSS REFERENCE TO RELATED APPLICATIONS

This application is a Divisional of U.S. patent application Ser. No. 11/774,094, filed on Jul. 6, 2007, which claims priority of Taiwan Patent Application No. 096101237, filed on Jan. 12, 2007, the entirety of which are incorporated by reference herein.

BACKGROUND OF THE INVENTION

1. Field of the Invention

The invention relates to semiconductor integrated circuits and more particularly to an on-chip inductor with multi-trace structure.

2. Description of the Related Art

Many digital and analog elements and circuits have been successfully applied to semiconductor integrated circuits. Such elements may include passive components, such as resistors, capacitors, or inductors. Typically, a semiconductor integrated circuit includes a silicon substrate. One or more dielectric layers are disposed on the substrate, and one or more metal layers are disposed in the dielectric layers. The metal layers may be employed to form on-chip elements, such as on-chip inductors, by current semiconductor technologies.

Conventionally, an on-chip inductor is formed over a semiconductor substrate and employed in integrated circuits designed for the radio frequency (RF) band. FIGS. 1A and 1B illustrate a plan view of a conventional on-chip inductor with a planar spiral configuration and a cross-section along 1B-1B' line shown in FIG. 1A, respectively. The on-chip inductor is formed in a dielectric layer 104 on a substrate 100, comprising a spiral conductive trace 103 and an interconnect structure. The spiral conductive trace 103 is embedded in the dielectric layer 104. The interconnect structure includes conductive plugs 105 and 109 and a conductive trace 107 embedded in a dielectric layer 102 and a signal output/input conductive trace 111 embedded in the dielectric layer 104. The dielectric layer 102 is disposed between the dielectric layer 104 and the substrate 100. An internal circuit of the chip or an external circuit may provides a current passing through the coil, which includes the conductive trace 103, the conductive plugs 105 and 109, the conductive trace 107, and the signal output/input conductive trace 111.

A principle advantage of the planar spiral inductor is the increased level of circuit integration due to the reduced number off-chip circuit elements and the complex interconnections required thereby. Moreover, the planar spiral inductor can reduce parasitic effect induced by the bond pads or bond wires between on-chip and off-chip circuits.

As integrated circuit (IC) designs have progressed, there has been an increased interest in integrating several different functions on a single chip while minimizing process complexity and any resulting impact on manufacturing yield. This integration of several different functions on a single chip is known as system on chip (SOC). Additionally, with the rapid development of communication systems, an SOC typically includes radio frequency (RF) circuits and digital or baseband circuits. Since the RF circuits in an SOC are smaller than the digital or baseband circuits, chip fabrication employs a digital or baseband circuit process. Accordingly, inductor traces in SOC are thinner compared to the inductors of general RF circuits, resulting reduced quality factor (Q value).

Since the performance of integrated circuit devices is based on the Q value of the on-chip inductors, there is a need to develop an on-chip inductor with increased Q value.

BRIEF SUMMARY OF INVENTION

A detailed description is given in the following embodiments with reference to the accompanying drawings.

A spiral inductor with a multi-trace structure is provided. An embodiment of a spiral inductor with a multi-trace structure comprises an insulating layer disposed on a substrate. A first spiral conductive trace with multiple turns is disposed on the insulating layer, wherein the outermost turn and the innermost turn of the first spiral conductive trace have a first end and a second end, respectively, and one of the first and second ends is connected to ground. A second spiral conductive trace with a single turn is disposed on the insulating layer and adjacent to the first spiral conductive trace, wherein the second spiral conductive trace is electrically connected to the turn that is connected to the ground and belongs to the first spiral conductive trace. The first spiral conductive trace has a relative outside and a relative inside, wherein the end of the first spiral conductive trace connected to ground and the second spiral conductive trace are located at different sides respectively.

Another embodiment of a spiral inductor with a multi-trace structure comprises an insulating layer disposed on a substrate. A first spiral conductive trace with multiple turns is disposed on the insulating layer, wherein the outermost turn of the first spiral conductive trace is connected to ground. At least one second spiral conductive trace with a single turn is disposed on the insulating layer and located inside the innermost turn of the first spiral conductive trace, wherein the second spiral conductive trace is connected to the outermost turn of the first spiral conductive trace to form the multi-trace structure.

Another embodiment of a spiral inductor with a multi-trace structure comprises an insulating layer disposed on a substrate. A first spiral conductive trace with multiple turns is disposed on the insulating layer, wherein the innermost turn of the first spiral conductive trace is connected to ground. At least one second spiral conductive trace with a single turn is disposed on the insulating layer and located outside the outermost turn of the first spiral conductive trace, wherein the second spiral conductive trace is connected to the innermost turn of the first spiral conductive trace to form the multi-trace structure.

BRIEF DESCRIPTION OF DRAWINGS

The invention can be more fully understood by reading the subsequent detailed description and examples with references made to the accompanying drawings, wherein.

DETAILED DESCRIPTION OF INVENTION

The following description is of the best-contemplated mode of carrying out the invention. This description is provided for the purpose of illustrating the general principles of the invention and should not be taken in a limiting sense. The scope of the invention is best determined by reference to the appended claims. The inductor of the invention will be described in the following with reference to the accompanying drawings.

The invention relates to a spiral inductor with a multi-trace structure, comprising a spiral conductive trace with multiple turns. The outermost turn and the innermost turn of the spiral conductive trace have a first end and a second end, respectively. If the first end of the outermost turn of the spiral conductive trace is connected to the ground, there is an additional spiral conductive trace with a single turn located inside the innermost turn of the spiral conductive trace and electrically connected in parallel to the outermost turn of the spiral conductive trace. Additionally, if the second end of the innermost turn of the spiral conductive trace is connected to ground, an additional spiral conductive trace with a single turn is located outside the outermost turn of the spiral conductive trace and electrically connected in parallel to the innermost turn of the spiral conductive trace. That is, the additional spiral conductive trace with a single turn and the grounding end of the turn of the spiral conductive trace are located inside and outside the spiral conductive trace with multiple turns, respectively, or located outside and inside the spiral conductive trace with multiple turns, respectively.

Figure 1A:
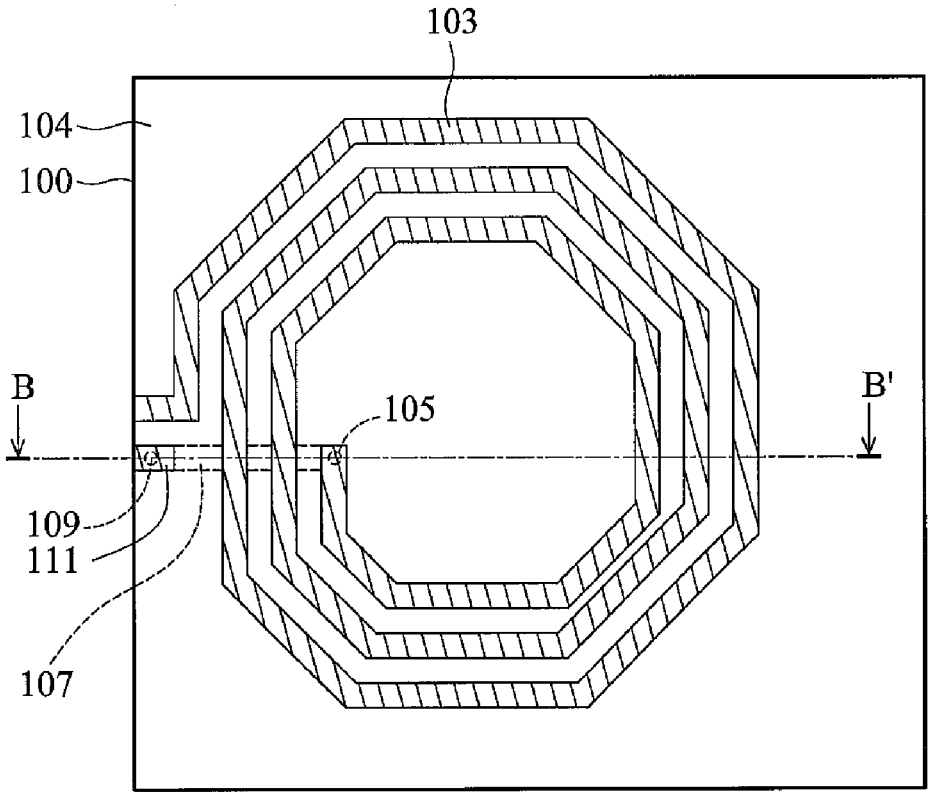
FIG. 1A ( PRIOR ART )
FIG. 1A is a plan view of a conventional on-chip inductor with a planar spiral configuration.
Figure 1B:
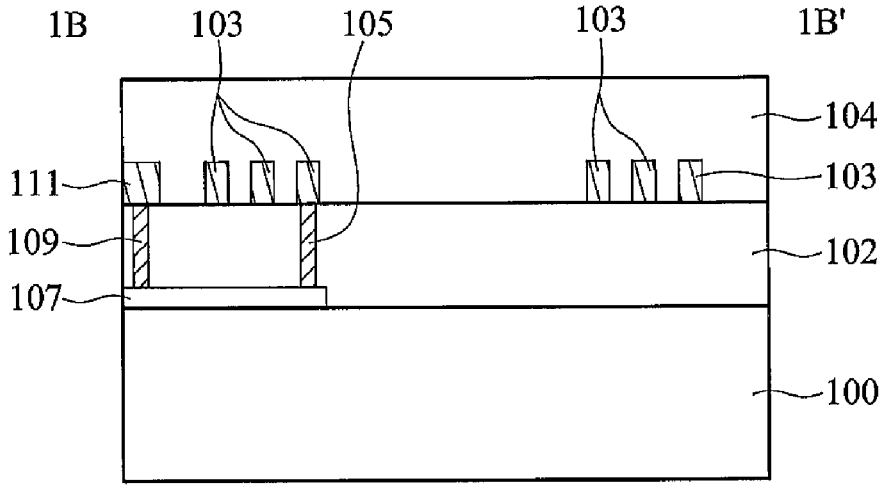
FIG. 1B ( PRIOR ART )
FIG. 1B shows a cross-section along 1B-1B' line shown in FIG. 1A.
Figure 2A:
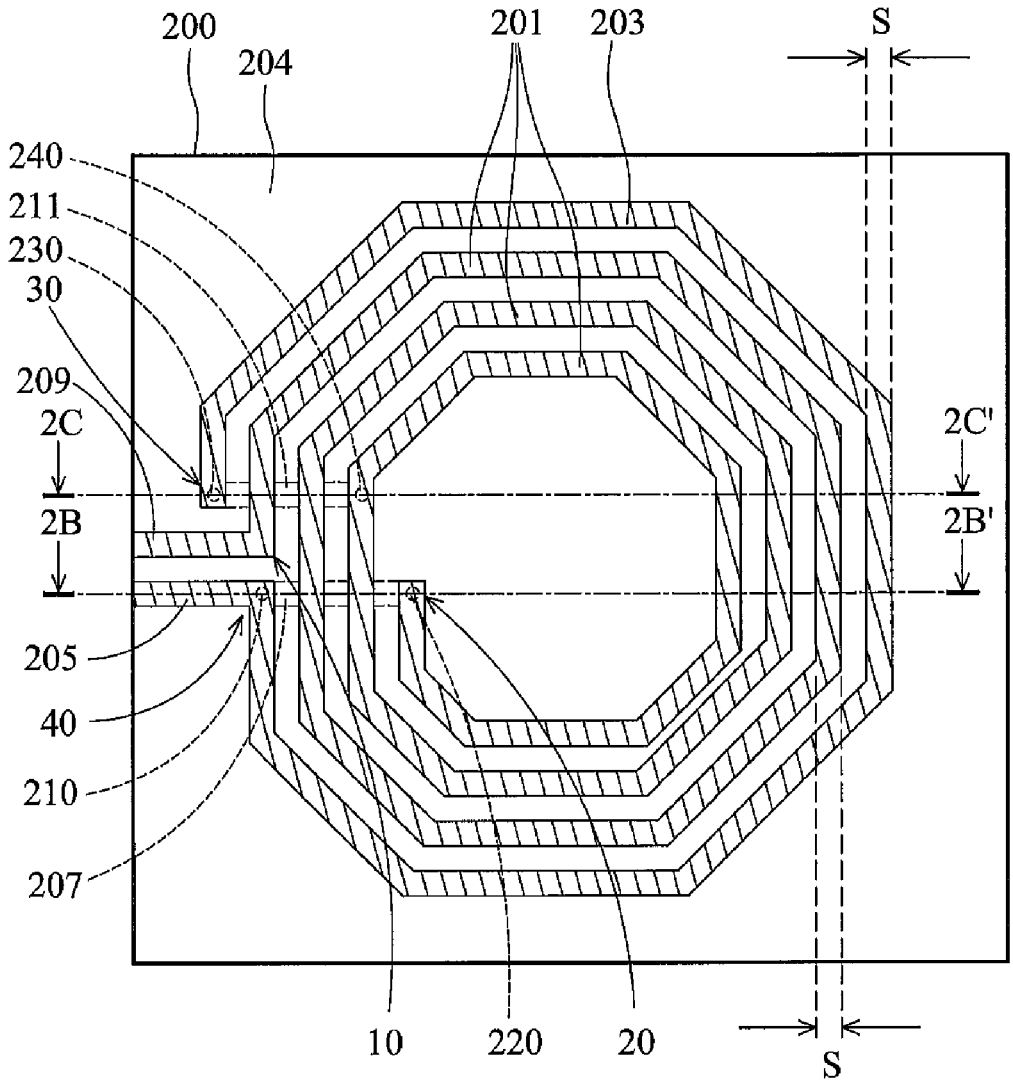
FIG. 2A is a plan view of an embodiment of a spiral inductor with a multi-trace structure.
Figure 2B:
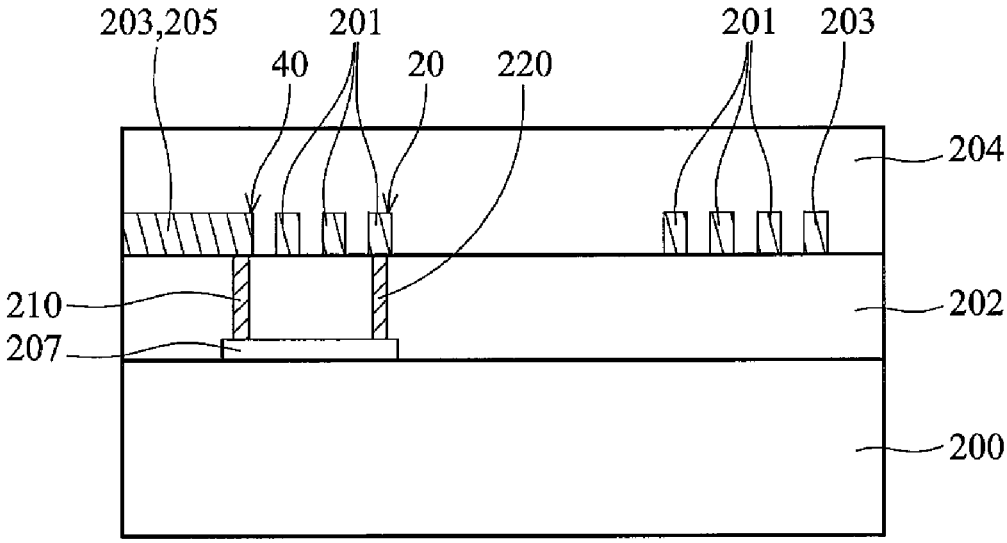
FIG. 2B shows a cross section along 2B-2B' line shown in FIG. 2A.
Figure 2C:
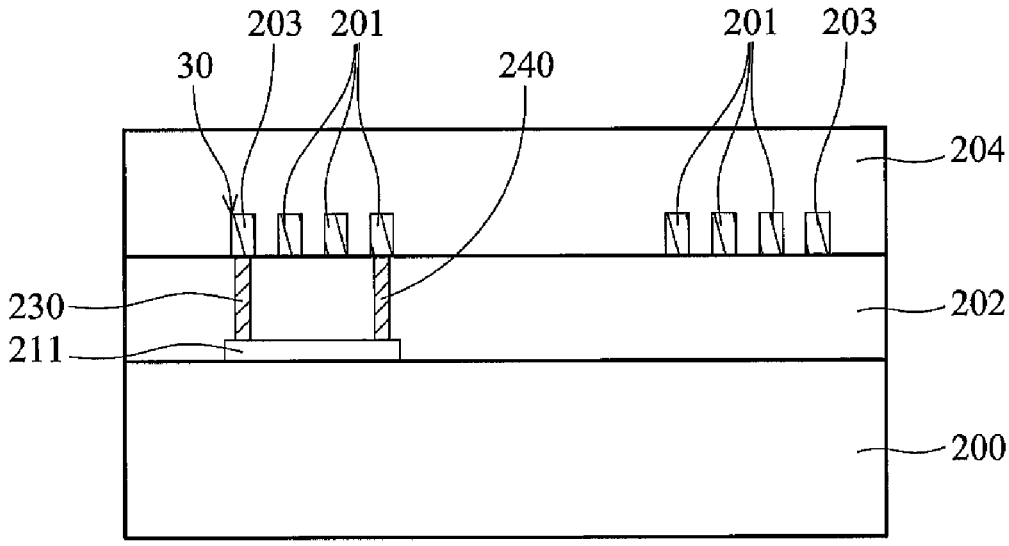
FIG. 2C shows a cross section along 2C-2C' line shown in FIG. 2A.

Referring to FIGS. 2A to 2C, in which FIG. 2A is a plan view of an embodiment of a spiral inductor with a multi-trace structure, FIG. 2B is a cross section along 2B-2B' line shown in FIG. 2A and FIG. 2C is a cross section along 2C-2C' line shown in FIG. 2A.

The spiral inductor comprises a spiral conductive trace 201 with multiple turns embedded in an insulating layer, at least one spiral conductive trace 203 with a single turn and connecting traces 207 and 211, in which the insulating layer is disposed on a substrate 200. The substrate 200 may include a silicon substrate or other well-known semiconductor substrate. The substrate 200 may include various elements, such as transistors, resistors, or other well-known semiconductor elements. Moreover, the substrate 200 may also include other conductive layers (e.g. copper, aluminum, or alloy thereof) and insulating layers (e.g. silicon oxide, silicon nitride, or low-k dielectric material). Hereinafter, to simplify the diagram, only a flat substrate is depicted.

In this embodiment, the insulating layer may comprise dielectric layers 202 and 204 successively disposed on the substrate 200. The dielectric layers 202 and 204 may include silicon oxide, silicon nitride, or low-k dielectric material.

The spiral conductive trace 201 with multiple turns is embedded in the dielectric layer 204 and may comprise, for example, three turns. The spiral conductive trace 201 with multiple turns may be circular, rectangular, hexagonal, octagonal or polygonal. Hereinafter, only an exemplary octagonal spiral conductive trace is depicted. The outermost turn and the innermost turn of the spiral conductive trace 201 with multiple turns have a first end 10 and a second end 20, respectively, in which a signal output/input trace 209 is located at the first end 10 to serve as a signal output/input terminal. Moreover, the spiral conductive trace 201 with multiple turns has a line width S and may comprise copper, aluminum or alloy thereof.

The second end 20 of the innermost turn of the spiral conductive trace 201 with multiple turns is connected to ground. Since the grounding second end 20 belongs the innermost turn of the spiral conductive trace 201 with multiple turns, there is a spiral conductive trace 203 with a single turn disposed outside the outermost turn of the spiral conductive trace 201 with multiple turns, and the spiral conductive trace 203 with a single turn is electrically connected in parallel to the innermost turn of the spiral conductive trace 201 with multiple turns.

The spiral conductive trace 203 with a single turn is embedded in the insulating layer 204 and located outside the outermost turn of the spiral conductive trace 201 with multiple turns. That is, the spiral conductive trace 203 with a single turn is substantially parallel to and surrounds the spiral conductive trace 201 with multiple turns.

The spiral conductive trace 203 with a single turn has a first end 30 and a second end 40, wherein the second end 40 corresponds to the second end 20 of the spiral conductive trace 201 with multiple turns. Moreover, a signal output/input trace 205 is located at the second end 40 of the spiral conductive trace 203 with a single turn to serve as a signal output/input terminal. In this embodiment, the signal output/input trace 205 is connected to ground. The spiral conductive trace 203 with a single turn has a line width substantially the same as the line width S of the spiral conductive trace 201 with multiple turns and may comprise copper, aluminum or alloy thereof.

The connecting traces 207 and 211 may comprise copper, aluminum or alloy thereof and are embedded in the dielectric layer 202 underlying the dielectric layer 204, thereby connecting the innermost turn of the spiral conductive trace 201 with multiple turns and the spiral conductive trace 203 with a single turn in parallel to form a multi-trace structure. For example, the connecting trace 207 is disposed between the second end 20 of the spiral conductive trace 201 with multiple turns and the second end 40 of the spiral conductive trace 203 with a single turn and is electrically connected between the innermost turn of the spiral conductive trace 201 with multiple turns and the spiral conductive trace 203 with a single turn by conductive plugs 210 and 220 disposed in the dielectric layer 202, respectively, as shown in FIG. 2B. Here, the innermost turn of the spiral conductive trace 201 with multiple turns is connected to ground through the connecting trace 207, the conductive plugs 210 and 220 and the signal output/input trace 205 of the spiral conductive trace 203 with a single turn. Moreover, the connecting trace 211 is disposed between the innermost turn of the spiral conductive trace 201 with multiple turns and the first end 30 of the spiral conductive trace 203 with a single turn and is electrically connected between the innermost turn of the spiral conductive trace 201 with multiple turns and the spiral conductive trace 203 with a single turn by conductive plugs 230 and 240 disposed in the dielectric layer 202, respectively, as shown in FIG. 2C.

Additionally, note that although the spiral conductive trace 201 with three turns is depicted in an exemplary embodiment, the spiral conductive trace 201 may comprise two or more than three turns. Moreover, although the spiral conductive trace 203 with a single turn and the innermost turn of the spiral conductive trace 201 with multiple turns are connected in parallel in an exemplary embodiment, the spiral conductive trace 201 with multiple turns may be connected in parallel to more than two spiral conductive traces with a single turn.

Figure 3A:
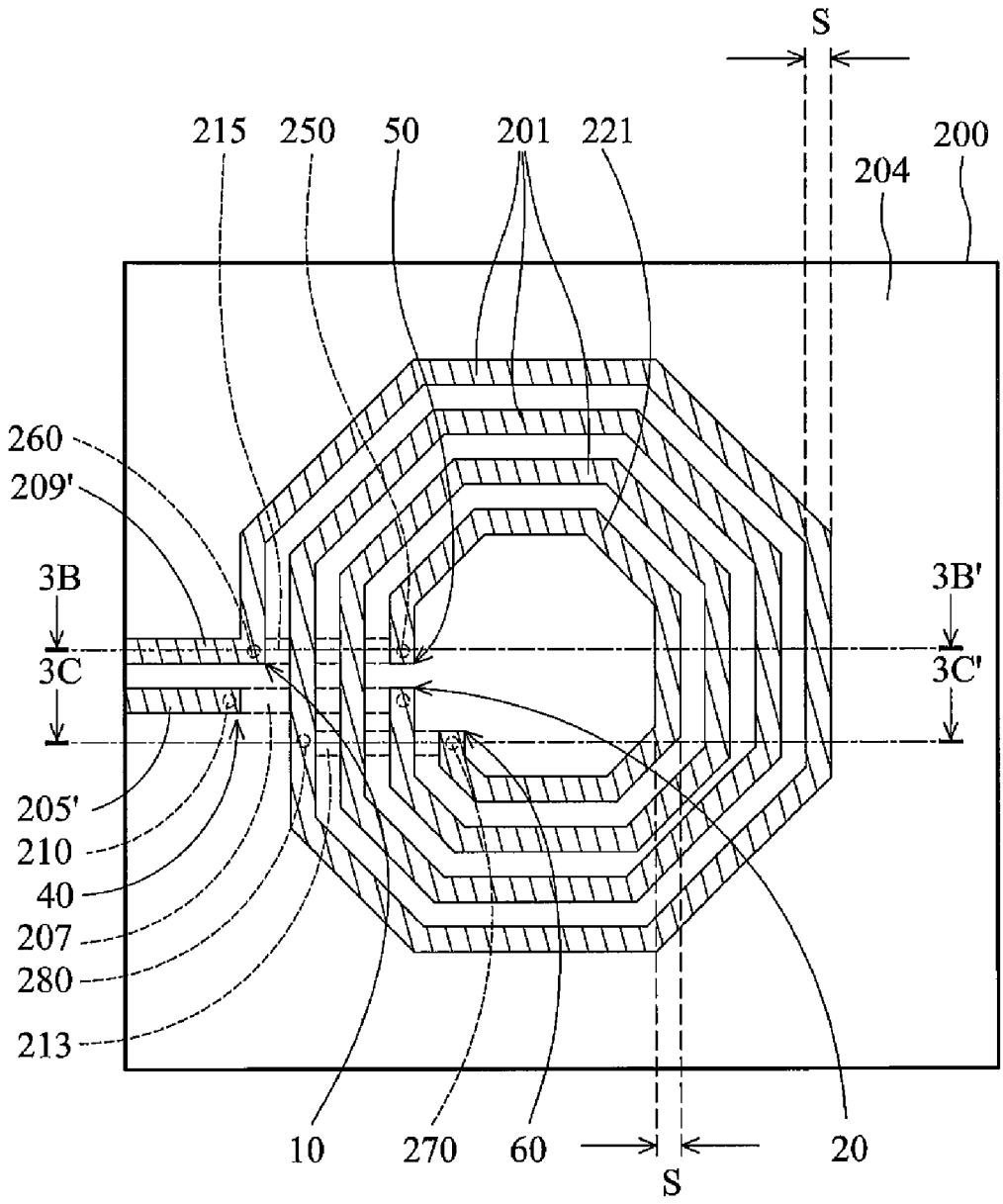
FIG. 3A is a plan view of an embodiment of a spiral inductor with a multi-trace structure.
Figure 3B:
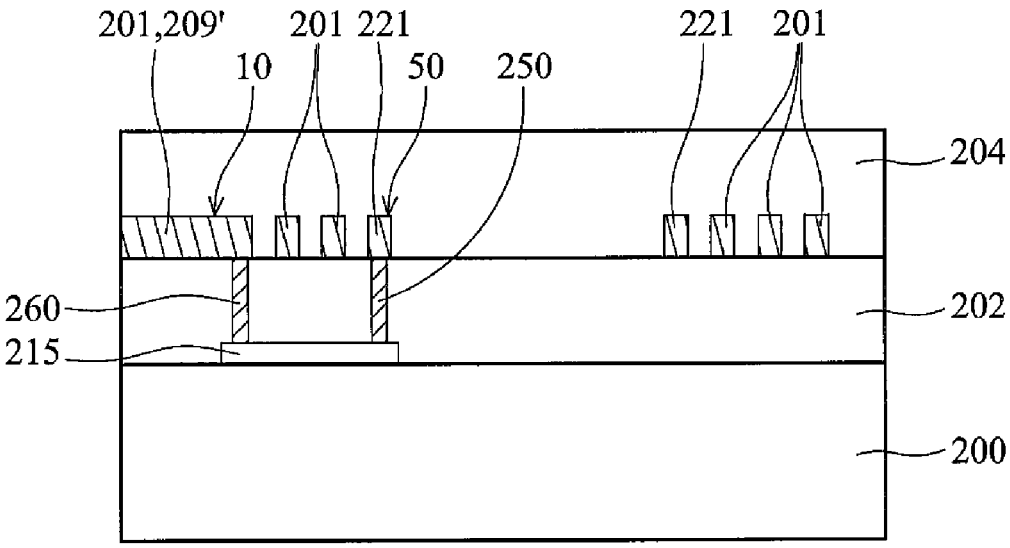
FIG. 3B shows a cross section along 3B-3B' line shown in FIG. 3A.
Figure 3C:
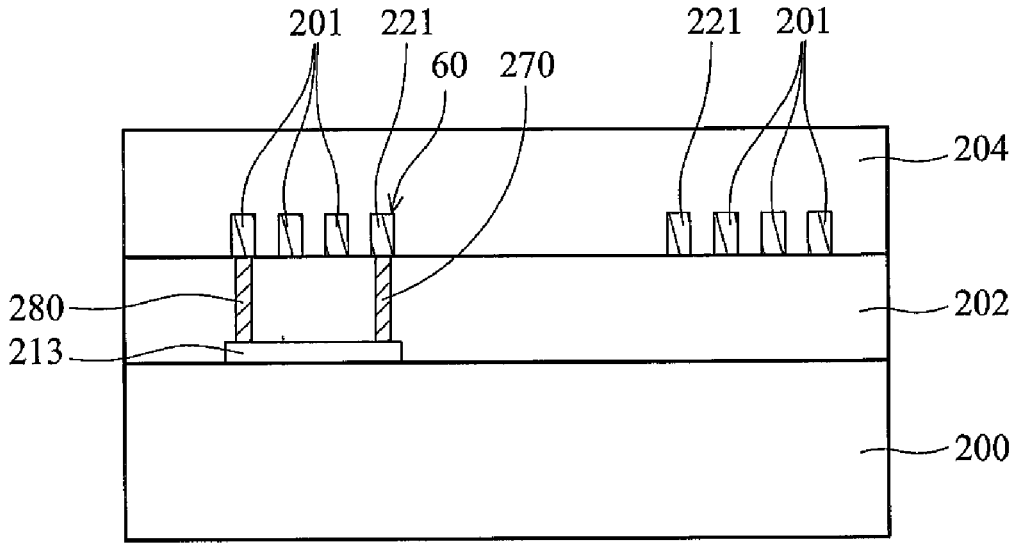
FIG. 3C shows a cross section along 3C-3C' line shown in FIG. 3A.

Referring to FIGS. 3A to 3C, in which FIG. 3A is a plan view of an embodiment of a spiral inductor with multi-trace structure, FIG. 3B is a cross section along 3B-3B' line shown in FIG. 3A and FIG. 3C is a cross section along 3C-3C' line shown in FIG. 3A. If the elements in FIGS. 3A to 3C are the same as those in FIGS. 2A to 2C, the elements will be labeled as the same reference numbers as FIGS. 2A to 2C use and will not be described again.

In this embodiment, the spiral inductor comprises a spiral conductive trace 201 with multiple turns and at least one spiral conductive trace 221 with a single turn embedded in a dielectric layer 204, and connecting traces 207, 213 and 215 embedded in a dielectric layer 202. Signal output/input traces 209' and 205' are disposed in the dielectric layer 204 and respectively corresponding to the first and second ends 10 and 20 of the spiral conductive trace 201 with multiple turns to serve as output/input terminals. The output/input trace 209' is formed by laterally extending the first end 10 of the spiral conductive trace 201 with multiple turns and the output/input trace 205' is electrically connected to the second end 20 of the spiral conductive trace 201 with multiple turns through the connecting trace 207 and conductive plugs 210 and 220. Here, the output/input trace 209' located at the first end 10 of the spiral conductive trace 201 with multiple turns is connected to ground.

Moreover, in this embodiment, the first end 10 of the outermost turn of the spiral conductive trace 201 with multiple turns is connected to ground. Since the grounding first end 10 is located at the outermost turn of the spiral conductive trace 201 with multiple turns, there is a spiral conductive trace 221 with a single turn disposed inside the innermost turn of the spiral conductive trace 201 with multiple turns, and the spiral conductive trace 221 with a single turn is electrically connected in parallel to the outermost turn of the spiral conductive trace 201 with multiple turns.

The spiral conductive trace 221 with a single turn is located inside the innermost turn of the spiral conductive trace 201 with multiple turns. That is, the spiral conductive trace 201 with multiple turns is substantially parallel to and surrounds the spiral conductive trace 221 with a single turn. The spiral conductive trace 221 with a single turn has a first end 50 and a second end 60, wherein the first end 50 corresponds to the first end 10 of the spiral conductive trace 201 with multiple turns.

The connecting traces 213 and 215 may comprise copper, aluminum or alloy thereof and are embedded in the dielectric layer 202 underlying the dielectric layer 204, thereby connecting the outermost turn of the spiral conductive trace 201 with multiple turns and the spiral conductive trace 221 with a single turn in parallel to form a multi-trace structure. For example, the connecting trace 213 is disposed between the first end 10 of the spiral conductive trace 201 with multiple turns and the first end 50 of the spiral conductive trace 221 with a single turn and is electrically connected between the outermost turn of the spiral conductive trace 201 with multiple turns and the spiral conductive trace 221 with a single turn by conductive plugs 250 and 260 disposed in the dielectric layer 202, respectively, as shown in FIG. 3B. Here, the first end 50 of the spiral conductive trace 221 with a single turn is connected to ground through the connecting trace 215, the conductive plugs 250 and 260 and the signal output/input trace 209' of the spiral conductive trace 201 with multiple turns. Moreover, the connecting trace 213 is disposed between the outermost turn of the spiral conductive trace 201 with multiple turns and the second end 60 of the spiral conductive trace 221 with a single turn and is electrically connected between the outermost turn of the spiral conductive trace 201 with multiple turns and the spiral conductive trace 221 with a single turn by conductive plugs 270 and 280 disposed in the dielectric layer 202, respectively, as shown in FIG. 3C.

Additionally, note that although the spiral conductive trace 221 with a single turn and the outermost turn of the spiral conductive trace 201 with multiple turns are connected in parallel in an exemplary embodiment, the spiral conductive trace 201 with multiple turns may be connected in parallel to more than two spiral conductive traces with a single turn.

In the described embodiments, the multi-trace structure of the spiral inductor is connected to ground. Because the grounding end of the spiral conductive trace 201 has a relatively higher current density (i.e. higher magnetic field) and a relatively lower electric field, the parasitic capacitance between the spiral conductive trace 203 with a single turn and the outermost turn of the spiral conductive trace 201 with multiple turns or the parasitic capacitance between the spiral conductive trace 221 with a single turn and the innermost turn of the spiral conductive trace 201 with multiple turns can be reduced. Moreover, since the innermost turn (or the outermost turn) of the spiral inductor has a multi-trace structure formed by the spiral conductive trace 203 with a single turn (or the spiral conductive trace 221 with a single turn), inductive coupling can be increased and the conductor loss of the spiral conductive trace 201 with multiple turns can be reduced to increase the Q value of the inductor and enhance the inductor efficiency without increasing the thickness of the spiral conductive trace 201 with multiple turns. Accordingly, the Q value of the spiral inductor according to the invention can be increased while maintaining the operational frequency range of the inductor.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A spiral inductor with a multi-trace structure, comprising:

an insulating layer disposed on a substrate;

a first spiral conductive trace with multiple turns disposed on the insulating layer, wherein the outermost turn of the first spiral conductive trace is connected to ground; and at least one second spiral conductive trace with a single turn disposed on the insulating layer and located inside the innermost turn of the first spiral conductive trace, wherein the second spiral conductive trace is connected to the outermost turn of the first spiral conductive trace to form the multi-trace structure.

2. The spiral inductor as claimed in claim 1, wherein the first spiral conductive trace is parallel to the second spiral conductive trace.

3. The spiral inductor as claimed in claim 2, further comprising a connecting trace disposed in the insulating layer for electrically connecting an end of the outermost turn of the first spiral conductive trace to a corresponding end of the second spiral conductive trace.

4. The spiral inductor as claimed in claim 1, wherein the first and second spiral conductive traces have the same line width.

5. The spiral inductor as claimed in claim 1, wherein the first and second spiral conductive traces are circular, rectangular, hexagonal, octagonal or polygonal.

6. The spiral inductor as claimed in claim 1, wherein the second spiral conductive trace and the outermost turn of the first spiral conductive trace are electrically connected in parallel.

* * * * *